US005618644A

United States Patent [19]

Morita

[11] Patent Number: 5,618,644

[45] Date of Patent: Apr. 8, 1997

[54] METHOD OF MONITORING WASHING WATER FOR A DEVELOPING PROCESS OF A PHOTOSENSITIVE MATERIAL

[75] Inventor: Satoshi Morita, Kanagawa, Japan

[73] Assignee: Fuji Photo Film Co., Ltd., Kanagawa, Japan

[21] Appl. No.: 444,031

[22] Filed: May 18, 1995

[30] Foreign Application Priority Data

May 25, 1994 [JP] Japan ..... 6-111436

[51] Int. Cl.[6] ..... G03C 5/00; G03C 3/00; G03C 11/00

[52] U.S. Cl. ..... 430/30; 430/398; 430/463

[58] Field of Search ..... 430/30, 398, 463

[56] References Cited

U.S. PATENT DOCUMENTS 4,977,067 12/1990 Yoshikawa et al. ..... 430/398
4,995,913 2/1991 Juers ..... 430/398

FOREIGN PATENT DOCUMENTS 0114402 8/1984 European Pat. Off. ..... 430/30
60-156063 8/1985 Japan ..... 430/30
4-142538 5/1992 Japan ..... 430/463

*Primary Examiner*—Glenn A. Caldarola
*Assistant Examiner*—J. Pasterczyk
*Attorney, Agent, or Firm*—Sughrue, Mion, Zinn, Macpeak & Seas

[57] ABSTRACT

In a method of monitoring washing water used in a developing process of a photosensitive material, a reference conductivity of the washing water is first calculated in accordance with a equation and based on the conductivity of a processing solution in a bleaching/fixing tank and the conductivity of fresh water for replenishing the washing tank. The conductivity of the washing water in the washing tank is compared with the reference conductivity to determine the degree of contamination of the washing water. Since the conductivity of the processing solution may vary due to evaporation thereof or the like, the reference conductivity is updated at periodic intervals. Accordingly, the degree of contamination can always be determined based on a proper reference conductivity.

30 Claims, 12 Drawing Sheets

METHOD OF MONITORING WASHING WATER FOR A DEVELOPING PROCESS OF A PHOTOSENSITIVE MATERIAL

BACKGROUND OF THE INVENTION

1. Field of the Invention

The present invention relates to a method of monitoring washing water used in developing a photosensitive material. In the method, washing water is stored in a washing tank, which is one of a plurality of processing tanks for processing a photosensitive material such as photographic film. The washing water is monitored so as to determine the degree of mixing of the water with a processing solution or processing solutions used in preceding stages. (Processing solution(s) in the processing tank(s) are located on the upstream side of the washing tank in the direction of flow of the photosensitive material.) The mixture of the processing solution(s) in the washing water occurs due to processing of the photosensitive material.

2. Description of the Related Art

In a developing process, a photosensitive material is successively immersed into various processing solutions such as a color developing solution and a bleaching/fixing solution, and is then washed with water before being transported to a drying section.

In general, a plurality of washing tanks storing washing water are provided to wash a photosensitive material. Since processing solutions which have adhered to a photosensitive material in preceding stages are gradually removed from the material in the plurality of washing tanks, the degree of contamination (especially, the degree of mixing of a bleaching/fixing solution) is relatively small in the final washing tank. However, it is sometimes observed, after repeated development, that the bleaching/fixing solution has been mixed into the washing water in the final washing tank.

This mixing is caused by processing solutions transported by the photosensitive material, as well as by water drops containing agents which adhere to a ceiling of a laboratory due to evaporation of processing solutions and then fall into the washing tanks.

In a so-called mulch-chamber washing tank in which a washing tank is divided into upper and lower tanks and the upper tank is further divided into left-hand and right-hand tanks, contamination of washing water in the final washing tank proceeds quickly if washing water leaks through an opening formed in each partition for a photosensitive material. Although each partition is provided with blades and rollers for separating washing tanks on both sides thereof, a considerable leak may occur due to a mechanical malfunction.

A known technique is to replenish fresh water in the washing water when the degree of contamination exceeds a predetermined value. However, published documents disclose neither means for detecting the degree of contamination, nor control based on the detected degree of contamination. Accordingly, the problem of contamination of washing water is usually avoided by replenishing fresh water or replacing the washing water at empirically determined intervals.

In such an empirical manner, it is unclear that washing water is properly replenished or exchanged. Therefore, to maintain the quality of development, washing water must be replenished or exchanged frequently, which increases the amount of nonproductive work and the amount of waste water attempts to minimize the frequency of replenishment or exchange of washing water may adversely affect on the quality of development of the photosensitive material.

SUMMARY OF THE INVENTION

In view of the above-described problems, an object of the present invention is to provide an improved method of monitoring washing water used in a developing process of a photosensitive material which can accurately detect the degree of mixing of a processing solution or processing solutions of preceding stages into washing water in a final washing tank, thereby making it possible to replenish or exchange the washing water with a proper amount of fresh water at a proper timing so as to maintain the quality of processing and the quality of development of a photosensitive material, and to improve the maintenance of the washing tank.

The present invention provides methods of monitoring washing water used in a developing process of a photosensitive material, wherein washing water stored in a washing tank, which is one of a plurality of processing tanks for processing a photosensitive material, is monitored so as to determine the degree of mixing, in the washing water, of a processing solution containing at least a bleaching solution or a fixing solution, the mixture of the processing solution occurring due to processing of the photosensitive material in at least one processing tank located on the upstream side of the washing tank in the direction of flow of the photosensitive material.

More specifically a method according to a first aspect of the present invention comprises the steps of:

(a) calculating, at at least predetermined intervals, a reference conductivity of washing water in a washing tank in accordance with a predetermined equation and based on the conductivity of a processing solution stored in a processing tank and the conductivity of replenishing water for replenishing the washing tank, and storing the reference conductivity in memory means to renew the reference conductivity;

(b) measuring the conductivity of the washing water in the washing tank at predetermined intervals; and (c) comparing the measured conductivity of the washing water and the reference conductivity to determine the degree of mixing of the processing solution in the washing water in the washing tank.

According to the first aspect, the conductivity Cp of a processing solution (bleaching solution, fixing solution, or bleaching/fixing solution) and the conductivity Cw of replenishing water (fresh water) for replenishing the washing tank are measured in a state in which respective processing tanks are filled with predetermined processing solutions.

It is assumed that the developing process is affected when the ratio of a processing solution mixed in washing water in the washing tank exceeds a predetermined ratio, i.e., when the dilution ratio of the processing solution (ratio of the processing solution to the replenishing water) exceeds a predetermined dilution ratio m. The conductivity C of the washing water in the washing tank at that time is calculated as a reference conductivity.

The conductivity of the washing water in the washing tank can be represented by Equation (1):

$$C = Cp \cdot \frac{1}{m} + Cw \cdot \frac{m-1}{m}, \quad (1)$$

wherein C is a reference conductivity, Cp is the conductivity of the processing solution of a preceding stage, Cw is the conductivity of replenishing water (fresh water), and m is a dilution ratio.

Equation (1) can be arranged to obtain Equation 2:

$$C=(Cp-Cw)+Cw \quad (2)$$

Assuming that Cp>>Cw, Cp–Cw can be approximated as Cp to simplify Expression (2), thereby obtaining Expression 3:

$$C=Cp/m+Cw \quad (3)$$

In some cases, an additive is added to the washing water in the washing tank to prevent the generation of bacteria and algae in the water. Since the conductivity of the water varies due to the addition of the additive, a term for compensating for variation in the conductivity due to the addition of the additive (hereinafter referred to as a "term for chemical compensation f(m)") must be introduced. The influence of the additive on the conductivity generally varies with variation in the dilution ratio. The relationship between the variation in the conductivity of washing water to be compensated for and the dilution ratio can be experimentally determined (see Table 2 in the description of embodiments).

By introducing the term for chemical compensation f(m) into Equation (3), the following Equation (4) is obtained:

$$C=Cp/m+Cw+f(m) \quad (2)$$

The conductivity C is calculated by Equation (4) at at least predetermined intervals and is stored as a reference conductivity so as to update the reference conductivity. This updating is performed because the influence of the processing solution mixed into the water in the washing tank varies due to variation in the density of the processing solution.

Although the reference conductivity C is obtained by calculation, the actual conductivity of water in the washing tank is separately measured at predetermined intervals. The degree of contamination which is mainly caused by the processing solution mixed into the water in the washing tank can be accurately determined by comparing the measured conductivity with the reference conductivity C calculated in the above-described manner.

A method according to a second aspect of the present invention comprises the steps of:

(a) storing, as a reference conductivity, a conductivity which is measured in a state in which a washing tank is filled with a diluted processing solution having a predetermined dilution ratio;

(b) draining the diluted solution and supplying fresh water as washing water to the washing tank to start processing operation;

(c) measuring the conductivity of the washing water in the washing tank at predetermined intervals; and (d) comparing the measured conductivity of the washing water and the reference conductivity to determine the degree of mixing of the processing solution in the washing water in the washing tank.

According to the second aspect, a processing solution is mixed with replenishing water (fresh water) in advance to obtain a diluted solution having a predetermined dilution ratio, which is then supplied to the washing tank. The conductivity of the diluted solution is measured, and the measured conductivity is stored as a reference conductivity. After the diluted solution is drained, fresh water is supplied to the washing tank and a processing operation is then started.

The conductivity of the washing water in the washing tank is measured at predetermined intervals. The degree of contamination which is mainly caused by the processing solution mixed into the water in the washing tank can be accurately determined by comparing the measured conductivity with the stored reference conductivity.

A method according to a third aspect of the present invention comprises the steps of:

(a) measuring the conductivity of a fresh processing solution and the conductivity of washing water contained in a washing tank, after filling a processing tank with the fresh processing solution;

(b) calculating a reference conductivity of washing water in the washing tank based on the results of the measurement in accordance with a predetermined equation, and storing the reference conductivity;

(c) measuring the conductivity of the washing water in the washing tank at predetermined intervals; and (d) comparing the measured conductivity of the washing water and the reference conductivity to determine the degree of mixing of the processing solution in the washing water in the washing tank.

According to the third aspect, a mother liquid of a processing solution prepared from a bleaching solution, fixing solution, or bleaching/fixing solution is first supplied to a processing tank, and the conductivity of the mother liquid is then measured. Also, the conductivity of washing water in the washing tank is measured. A reference conductivity is calculated based on the results of the measurement in accordance with Equation (4) and is stored. Unlike the first aspect, the conductivity of a mother liquid, or a fresh processing solution, is obtained in the method according to the third aspect. Accordingly, in the method according to the third aspect, the reference conductivity is required to be renewed only when the processing solution is exchanged (i.e., when the processing solution is drained completely and a fresh processing solution is then supplied). This makes control simpler.

The conductivity of washing water in the washing tank is measured at predetermined intervals in the same manner as in the methods according to the first and second aspects. The degree of contamination which is mainly caused by the processing solution mixed into the water in the washing tank can be accurately determined by comparing the measured conductivity with the stored reference conductivity.

According to a fourth aspect of the present invention, an additional feature is added to the methods according to the first through third aspects so as to predict, based on variation in the measured conductivity of washing water, the time when the conductivity of washing water reaches the reference conductivity.

In the invention according to the fourth aspect, the amount of variation in the measured conductivity of washing water from the conductivity measured in the previous cycle is calculated and is compared with the average of variations measured in several (about ten) past cycles so as to judge whether an abrupt variation occurs. This makes it possible to predict the time when the conductivity of the washing water reaches the reference conductivity even when the conductivity abruptly varies. Specifically, the variation in conductivity per unit time of the past cycles and/or the variation in conductivity per unit area of the processed photosensitive material of the past cycles are compared with the respective variations of the past cycles. By comparing the respective variations with a value set in advance, abnormalities in the liquid can be detected. Further, the time when the allowed reference conductivity is exceeded can be more accurately predicted by independently calculating the amount of variation in conductivity per unit time and the amount of variation in conductivity per unit area of the processed photosensitive material. Therefore, when a processing solution abruptly flows into the washing tank due to a leak though a partition between the processing tanks, such an abnormal condition can be detected before the conductivity of the washing water actually exceeds the reference conductivity, and a necessary step can be quickly taken before the processing quality of a photosensitive material is deteriorated.

DESCRIPTION OF THE PREFERRED EMBODIMENTS

Embodiments of the present invention will now be described with reference to the accompanying drawings.

Figure 1:
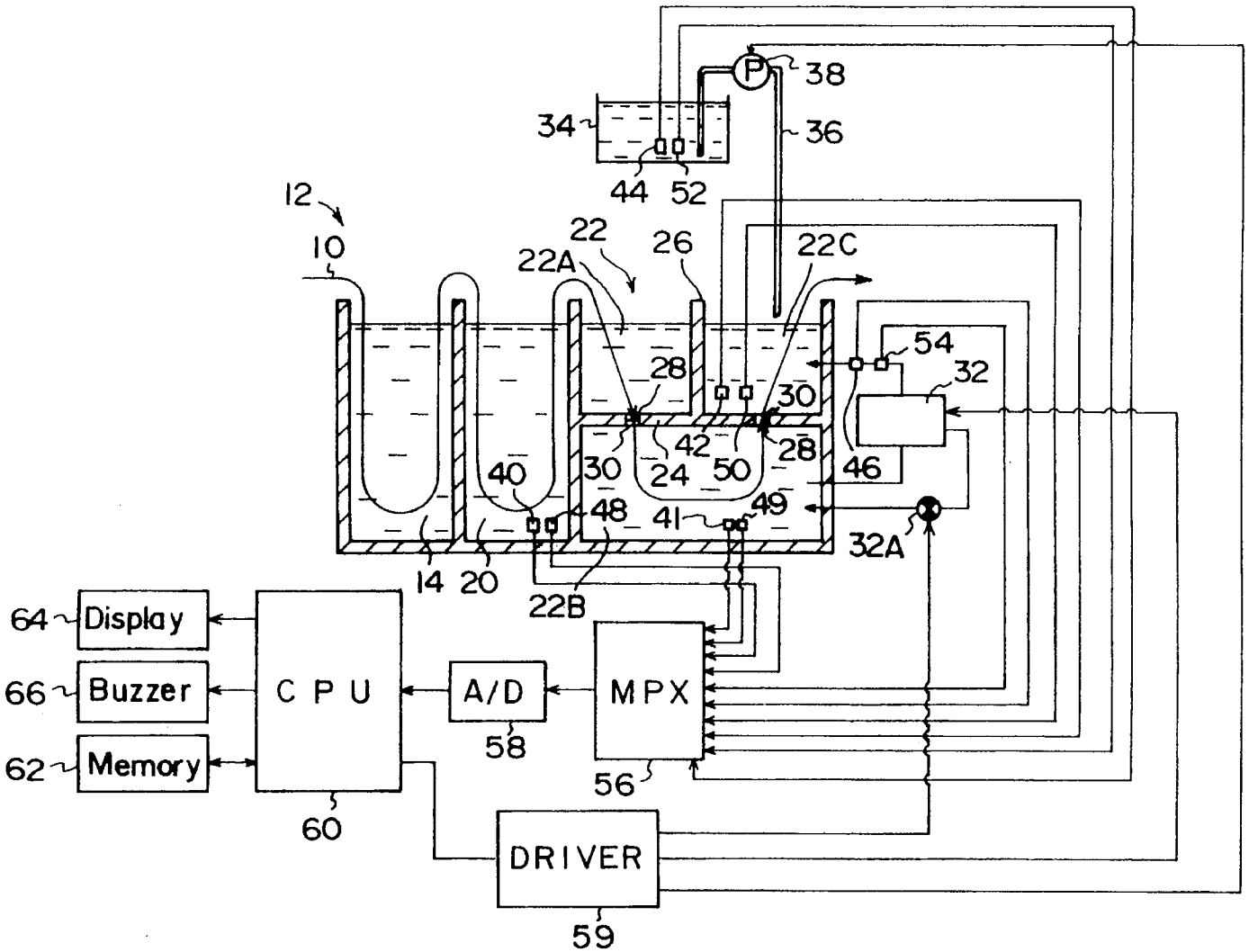
FIG. 1 is a schematic view of a photosensitive material processing apparatus used for carrying out methods according to first through fourth embodiments of the present invention.

First Embodiment:

FIG. 1 shows a photosensitive material processing apparatus used in the present embodiment.

A photosensitive material 10 is subjected to an exposure process in the preceding stage (not shown), and is then conveyed to a developing section 12.

In the developing section 12, a plurality of processing tanks (a color developing tank 14, and a bleaching/fixing tank 20 from the left in FIG. 1) are provided. Each tank is equipped with racks (not shown) to which rollers and guide plates are mounted. The photosensitive material 10 is guided by the rollers and guide plates of the racks so that it is conveyed along a substantially U-like path in each processing tank as shown in FIG. 1. With this operation, the photosensitive material 10 is successively immersed into processing solutions in the processing tanks for development process and the like.

A multi-chamber washing section 22 is provided adjacent to the bleaching/fixing tank 20.

The multi-chamber washing section 22 is divided into upper and lower tanks by a partition 24, and the upper tanks is further divided into two tanks by a partition 26. As a result, the washing section 22 is divided into three washing tanks. Each washing tank is filled with washing water, and is equipped with racks. The partition 24 is formed with through openings 28 which connect the first washing tank 22A and the second washing tank 22B, and the second washing tank 22B and the third washing tank 22C, respectively. A check valve 30 is attached to each of the through openings 28. With this structure, the photosensitive material 10 leaving the bleaching/fixing tank 20 is successively immersed in the first, second and third washing tanks 22A, 22B and 22C to be washed.

In other words, developing solutions (especially, the processing solution in the bleaching/fixing tank 20) adhering to the photosensitive material 10 is removed by washing water while the photosensitive material 10 passes through the first, second and third washing tanks 22A, 22B and 22C.

As shown in FIG. 1, a purifier 32 is connected between the second washing tank 22B and the third washing tank 22C. The purifier 32 is connected to a controller (CPU) 60, and is turned on and off by the CPU 60 depending on the degree of contamination in the third washing tank 22C (the conductivity of washing water in the third washing tank 22C). When the purifier 32 is in an on state, the purifier 32 operates to feed washing water from the second washing tank 22B to the third washing tank 22C via a permeation membrane which mainly removes iron. Also, a return valve 32A is disposed in the middle of a drain pipe running from the purifier 32 to the second washing tank 22B. When the purifier 32 is in an off state, the return valve 32A is maintained open by a signal supplied from the CPU 60 via the driver 59, so that washing water sucked by the purifier 32 is returned to the second washing tank 22B.

Also, a tank 34 is provided to store replenishing water (fresh water), and the tip of a pipe 36 extending from the tank 34 is positioned in the third washing tank 22C. A pump 38 is disposed in the middle of the pipe 36 to supply the replenishing water from the tank 34 to the third washing tank 22C. Although a similar replenishing apparatus is provided for each of the processing tanks, only the tank 34 for the third washing tank 22C is shown in FIG. 1 and others are omitted.

Deionized water or ordinary city water is used as washing water. The conductivity of city water varies depending on areas, as shown in Table 1.

TABLE 1

Conductivity Of City Water in Various Areas

| Area | Conductivity (mS/cm) |
|---|---|
| Nerima-ku, Tokyo-to, Japan | 0.149 |
| Hiratsuka-shi, Kanagawa-ken, Japan | 0.153 |
| Nagoya-shi, Aichi-ken, Japan | 0.225 |
| Minamiashigara-shi, Kanagawa-ken, Japan | 0.229 |
| Okinawa-ken, Japan | 0.590 |
| Taiwan | 0.273 |
| Singapore | 0.543 |
| Los Angeles, U.S.A | 0.807 |
| Iran | 1.01 |
| Pakistan | 1.34 |
| Guam | 1.49 |
| Cyprus | 1.64 |

As is apparent from Table 1, the conductivity of city water varies depending on areas, especially depending on impurities (Ca, Mg, etc.) contained in city water. The conductivity of city water does not vary greatly within the same area. However, if city water is used as washing water, the conductivity greatly varies as the amount of the processing solution conveyed from in the bleaching/fixing tank 20 to the washing section 22 increases during repeated processing of the photosensitive material 10.

Conductivity sensors 40, 41, 42 and 44 are attached to the bleaching/fixing tank 20, the second washing tank 22B, the third washing tank 22C and the tank 34 to measure the conductivities of the processing solution and washing water in those tanks. Another conductivity sensor 46 is attached to the discharge pipe of the purifier 32.

Moreover, temperature sensors 48, 49, 50 and 52 are attached to the bleaching/fixing tank 20, the second washing tank 22B, the third washing tank 22C and the tank 34 to be adjacent to the conductivity sensors 40, 41, 42 and 44, respectively, so as to measure the temperatures of the processing solution and washing water in those tanks. Another temperature sensor 54 is attached to the discharge pipe of the purifier 32.

The conductivity sensors 40, 41, 42, 44 and 46, and the temperature sensors 48, 49, 50, 52 and 54 are all connected to a multiplexer 56. One of signals from the sensors is selected by the multiplexer 56 and is then input to the CPU 60 via an A/D converter 58.

A memory 62 is connected to the CPU 60. Values representing conductivities and temperatures detected by the sensors 40, etc., and results of calculation effected by the (CPU 60 are stored in the memory 62. The values and the results of calculation stored in the memory 62 are read out by the CPU 60 for processing in the CPU 60.

A display unit 64 and an alarm 66 such as a buzzer are connected to the CPU 60. When the conductivity of washing water in the third washing tank 22C exceeds a predetermined conductivity, the CPU 60 causes the display 64 to indicate it and activates the alarm 66.

The CPU 60 inputs, at predetermined intervals, the conductivity of a bleaching solution and/or fixing solution (i.e., a processing solution) in the bleaching/fixing tank 20 and the conductivity of washing water (fresh water) in the tank 34, which are measured by the sensors 40 and 44, and calculates a reference conductivity C according to the below-described Equation (4). The result of the calculation is stored in the memory 62. Consequently, a new reference conductivity C is stored in the memory 62 at the predetermined intervals to update the stored reference conductivity.

$$C=Cp/m+Cw+f(m) \quad (4)$$

Also, the conductivity Ct of washing water in the third washing tank 22C is detected by the sensor 42 at intervals which may be the same as or different from the above-described predetermined intervals. Upon the detection of the conductivity Ct, the CPU 60 compares the conductivity Ct with the reference conductivity C stored in the memory 62. When the detected conductivity Ct is greater than the reference conductivity C, the CPU 60 controls the display unit 64 and the alarm 66 to operate.

Figure 2A:
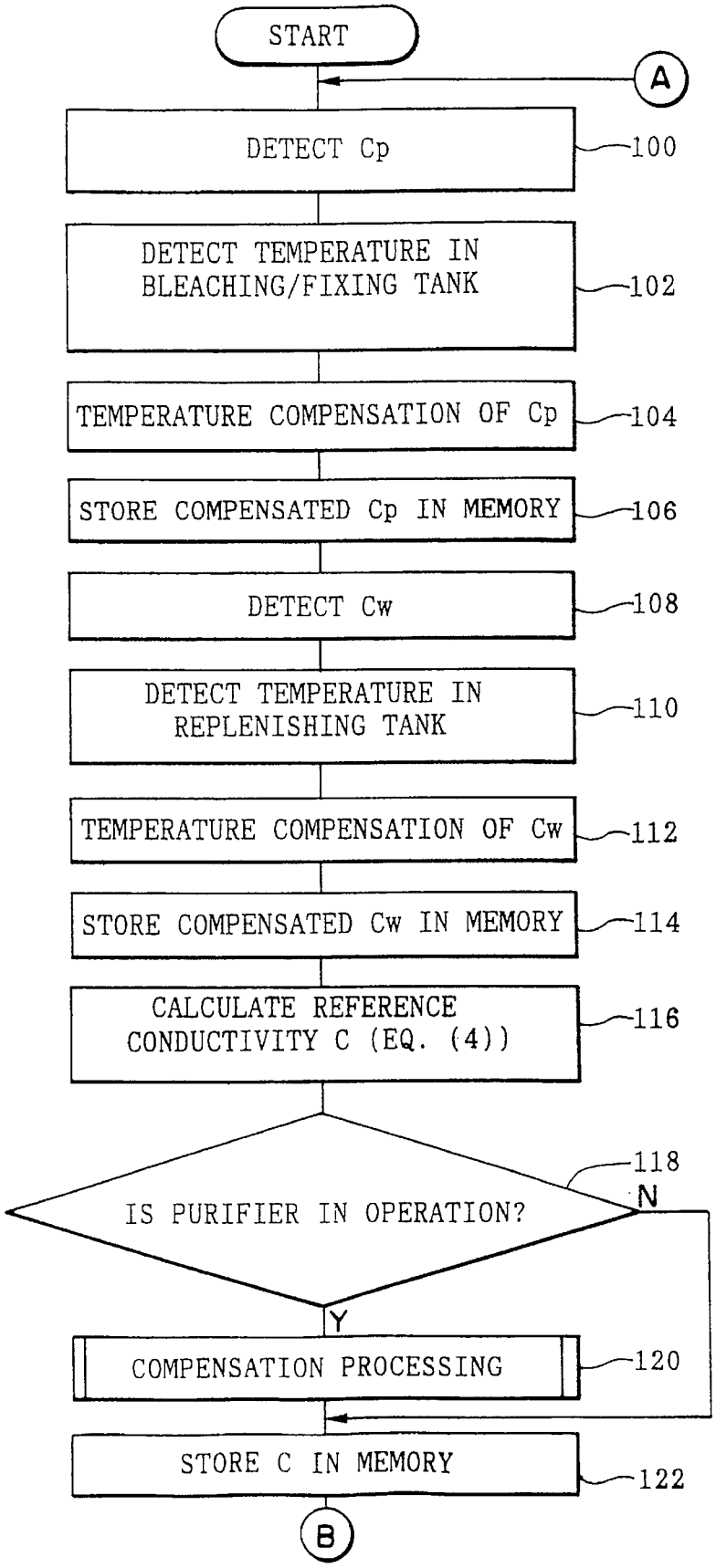
FIGS. 2A and 2B are control flowcharts according to the first embodiment of the present invention.
Figure 2B:
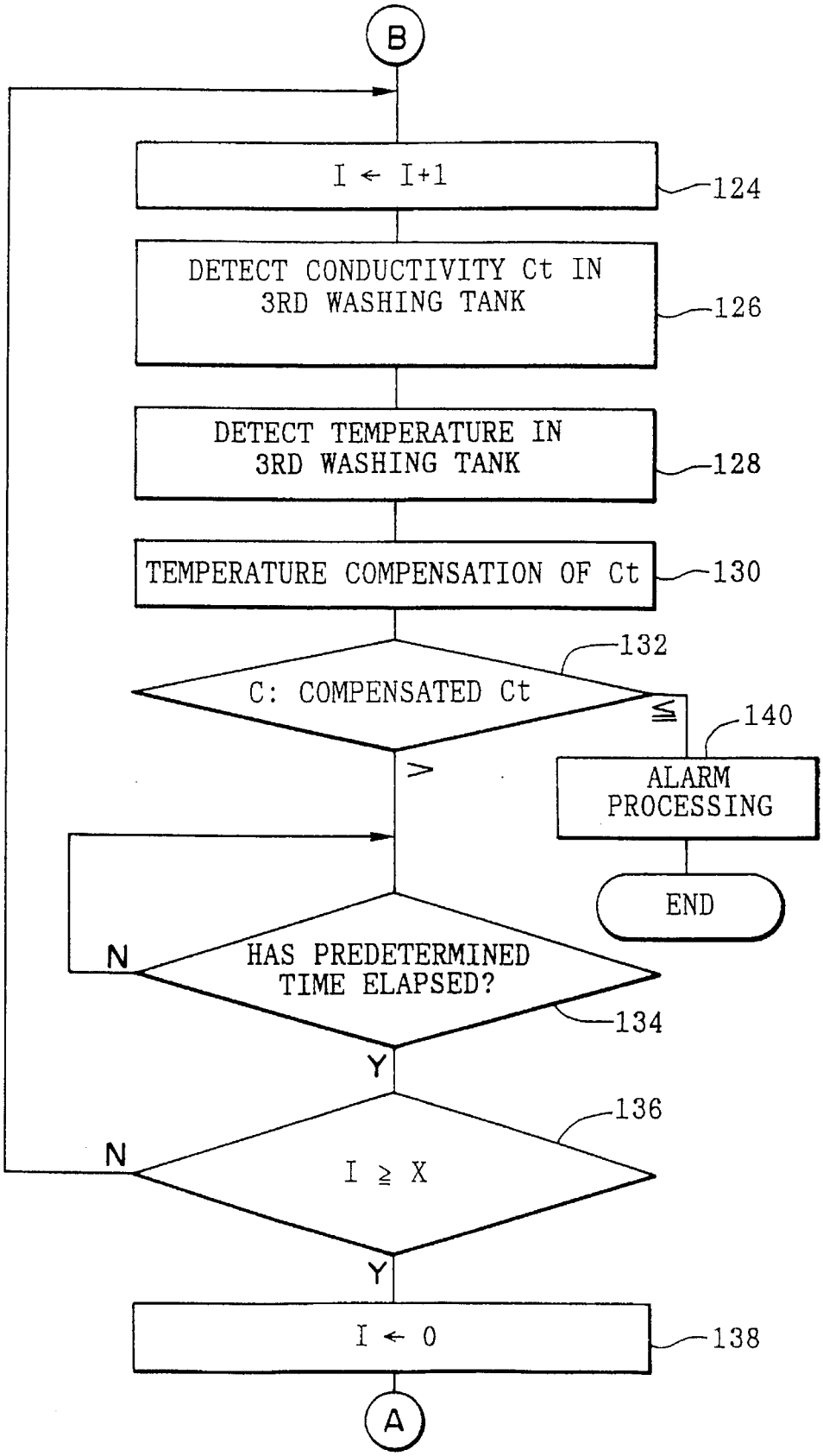

The operation of the first embodiment will be described with reference to the flowcharts shown in FIGS. 2A and 2B.

In step 100, the conductivity Cp of the processing solution in the bleaching/fixing tank 20 is detected by the sensor 40, and in step 102, the temperature of the processing solution is detected by the sensor 48. In subsequent step 104, the CPU 60 effects temperature compensation for the detected conductivity Cp. The compensated conductivity Cp is stored in the memory 62 in step 106.

In next step 108, the conductivity Cw of the replenishing water (fresh water) in the tank 34 is detected by the sensor 44, and in step 110, the temperature of the replenishing water is detected by the sensor 52. In subsequent step 112, the CPU 60 effects temperature compensation for the detected conductivity Cw. The compensated conductivity Cw is stored in the memory 62 in step 114.

In step 116, the CPU 60 calculates a reference conductivity C in accordance with Equation (4) and based on the compensated conductivity Cp and the compensated conductivity Cw, both stored in the memory 62.

In the present embodiment, for example, it is assumed that the compensated conductivity Cw of the replenishing water (fresh water) is 0.2 mS/cm which is the standard conductivity of city water in Japan (see Table 1), the compensated conductivity Cp of the processing solution (bleaching solution, fixing solution, or bleaching/fixing solution) is 120 mS/cm (standard value), and the allowable dilution ratio m in the third washing tank 22C is 500. The term for chemical compensation f(m) is determined based on the dilution ratio m. In the present embodiment, the value of the term f(m) is set to 0.621 mS/cm based on the below-described Table 2.

Using these parameters and in accordance with Equation (4), the CPU 60 calculates a reference conductivity C as follows:

$$C=120/500+0.2+0.621=1.061 \ (mS/cm)$$

TABLE 2

Values of Chemical Compensation to Dilution Ratio m

| Dilution ratio m | Value of chemical compensation f(m) | Dilution ratio m | Values of chemical compensation f(m) |
|---|---|---|---|
| 2000 | 0.159 | 60 | 4.117 |
| 1000 | 0.318 | 50 | 4.792 |
| 900 | 0.353 | 40 | 5.759 |
| 800 | 0.395 | 30 | 7.270 |
| 700 | 0.450 | 20 | 10.024 |
| 600 | 0.522 | 10 | 17.026 |
| 500 | 0.621 | 9 | 18.413 |
| 400 | 0.766 | 8 | 20.086 |
| 300 | 1.000 | 7 | 22.147 |
| 200 | 1.446 | 6 | 24.763 |
| 100 | 2.665 | 5 | 28.215 |
| 90 | 2.918 | 4 | 33.024 |
| 80 | 3.228 | 3 | 40.302 |
| 70 | 3.616 | 2 | 52.979 |

Figure 6:
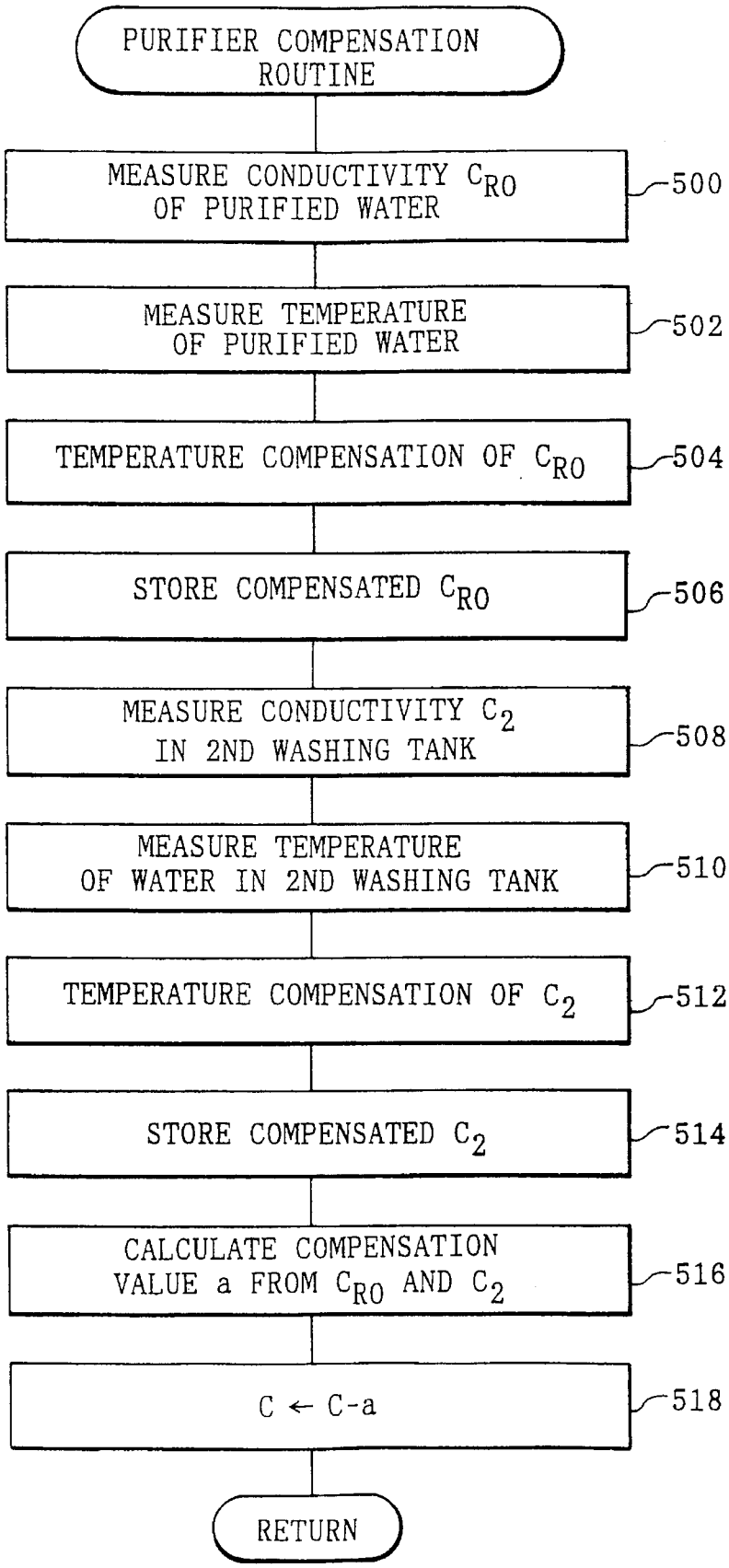
FIG. 6 is a flowchart showing a subroutine used in the first through fourth embodiments.

In step 118, it is judged whether the purifier 32 is in operation. When an affirmative judgment is made, the processing moves to step 120 in which compensation is performed. The compensation processing is shown in FIG. 6 and will be described later.

In step 122, the compensated reference conductivity C is stored in the memory 62. When a negative judgment is made in step 118, it is unnecessary to perform compensation. Therefore, the processing moves to step 122 by bypassing step 120.

In step 124, variable I is incremented, and the processing moves to step 126.

In step 126, the conductivity Ct of washing water in the third washing tank 22C is detected by the sensor 42, and in step 128, the temperature of the washing water in the third washing tank 22C is detected by the sensor 50. Subsequently, the processing moves to step 130 to carry out temperature compensation for the conductivity Ct.

In step 132, the CPU 60 compares the reference conductivity C stored in the memory 62 with the detected and compensated conductivity Ct. When it is judged that the measured conductivity Ct is smaller than the reference conductivity C, it means that washing water in the third washing tank 22C has not been contaminated to the degree which affects the processing of the photosensitive material. In this case, the processing moves to step 134 to judge whether a predetermined period of time has elapsed. If an affirmative judgment is made in this step, the processing moves to step 136 to judge whether the variable I reaches a predetermined value X. When a negative judgment is made, the processing moves to step 124. When an affirmative judgment is made, the processing moves to step 100 after resetting the variable I to zero in step 138.

By the above-described operation, the reference conductivity C is renewed every time the detection of the conductivity Ct and the comparison with the reference conductivity C are performed X times. The renewal of the reference conductivity C is performed because there is a possibility that the concentration of the processing solution in the bleaching/fixing tank 20 varies due to evaporation or the like, which causes variation in the conductivity of the processing solution. In the present invention, the reference conductivity C can be properly set based on the conductivity Cw of replenishing water.

When it is judged that the measured conductivity Ct is equal to or greater than the reference conductivity C, it means that washing water in the third washing tank 22C has been contaminated to the degree which affects the processing of the photosensitive material. In this case, the processing moves to step 140 to operate the display unit 64 and the alarm 66, thereby informing an operator of the occurrence of an abnormality. The processing is then stopped.

In the above-described first embodiment, the reference conductivity C is calculated from the conductivity Cp of the processing solution in the bleaching/fixing tank 20 and the conductivity Cw of the fresh water in the tank 34, using Equation (4), and is then compared with the conductivity Ct of washing water in the third washing tank 22C to determine the degree of contamination of the washing water in the third tank 22C. Accordingly, the degree of contamination of the washing water can be accurately and quickly determined. Also, the reference conductivity C is renewed at predetermined intervals (i.e., every time I reaches X), taking account of the fact that the conductivity Cp of the processing solution in the bleaching/fixing tank 20 may vary due to evaporation or the like. Accordingly, the degree of contamination can be accurately determined based on the reference conductivity C.

Next, the compensation routine performed in step 120 will be described with reference to FIG. 6.

In step 500, the conductivity $C_{R0}$ of the purified water is measured by the sensor 46, and in step 502, the temperature of the purified water is measured by the sensor 54. In step 504, the conductivity $C_{R0}$ is compensated based on the measured temperature, and the compensated conductivity $C_{R0}$ is stored in the memory 62 in step 506.

In step 508, the conductivity $C_2$ of washing water in the second washing tank 22B is measured by the sensor 42, and in step 510, the temperature of the washing water in the second washing tank is measured by the sensor 50. In step 512, the conductivity $C_2$ is compensated based on the measured temperature, and the compensated conductivity $C_2$ is stored in the memory 62 in step 514.

In next step 516, a compensation value a is computed from the compensated conductivity $C_{R0}$ of the purified water and the compensated conductivity $C_2$ of the washing water in the second washing tank 22B, both stored in the memory 62. In step 518, the reference conductivity C which is obtained in accordance with Equation (4) in step 518 is compensated (C–C–a). The processing then returns to the main routine.

Figure 7:
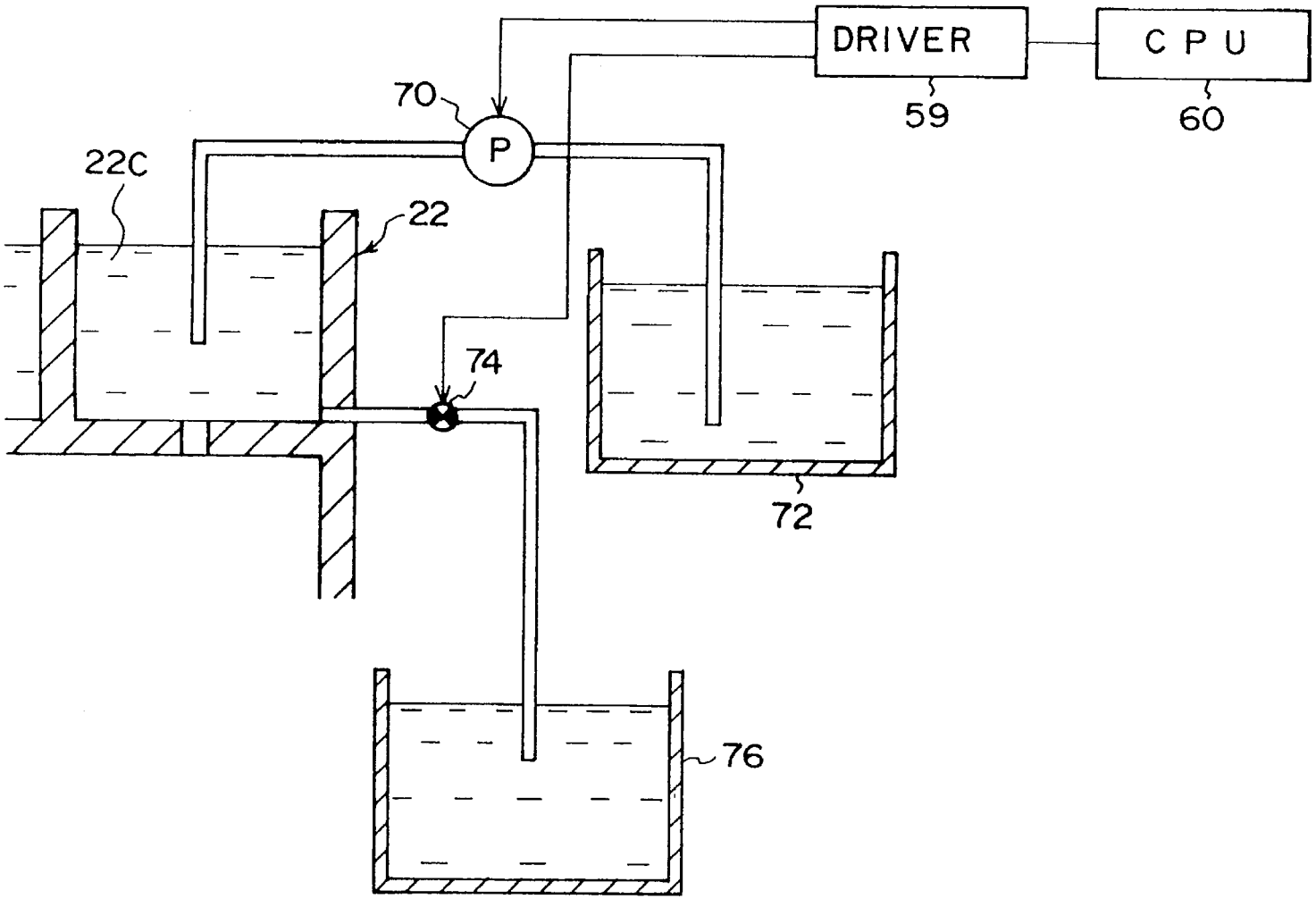
FIG. 7 is a schematic view showing a part of the processing apparatus comprising solution filling and drainage control according to the second embodiment.

Second Embodiment:

Next, a second embodiment of the present invention will be described with reference to FIG. 1 and FIG. 7. The feature of the second embodiment resides in determining the degree of contamination using a single conductivity sensor 42 provided in the third washing tank 22C (in the case where the purifier 32 is provided, the sensor 46 attached to the discharge piping of the purifier 32 is also necessary). As a result, the conductivity sensors 40 and 44 and the temperature sensors 48 and 52 can be omitted. FIG. 7 is a schematic view showing a part of the processing apparatus which part has a unique structure according to the second embodiment. The processing apparatus is provided with a diluted solution tank 72 which holds a diluted solution obtained by diluting a stock solution with fresh water at a predetermined dilution ratio. The diluted solution tank 72 is connected to the third washing tank 22C via a pipe with a pump 70 disposed in the middle thereof. When the pump 70 is operated, the diluted solution is supplied to the third washing tank 22C. The pump 70 is connected to the CPU 60 via the driver 59, and is turned on and off by the CPU 60. The third washing tank 22C is also connected to a waste-water tank 76 so as to drain the water from the third washing tank 22C to the waste-water tank 76. A solenoid valve 74 disposed in the middle of the pipe connecting to the third washing tank 22C to the waste-water tank 76 is connected to the CPU 60 via the driver 59, and is opened and closed by the CPU 60 in an on-and-off manner. If the need arises, the solenoid valve 74 is opened by the CPU 60 to drain the water in the third washing tank 22C to the waste-water tank 76. Other portions of the processing apparatus are the same as those shown in FIG. 1. These portions are indicated by the same symbols as those for the portions shown in FIG. 1, and description therefor will be omitted.

Figure 3A:
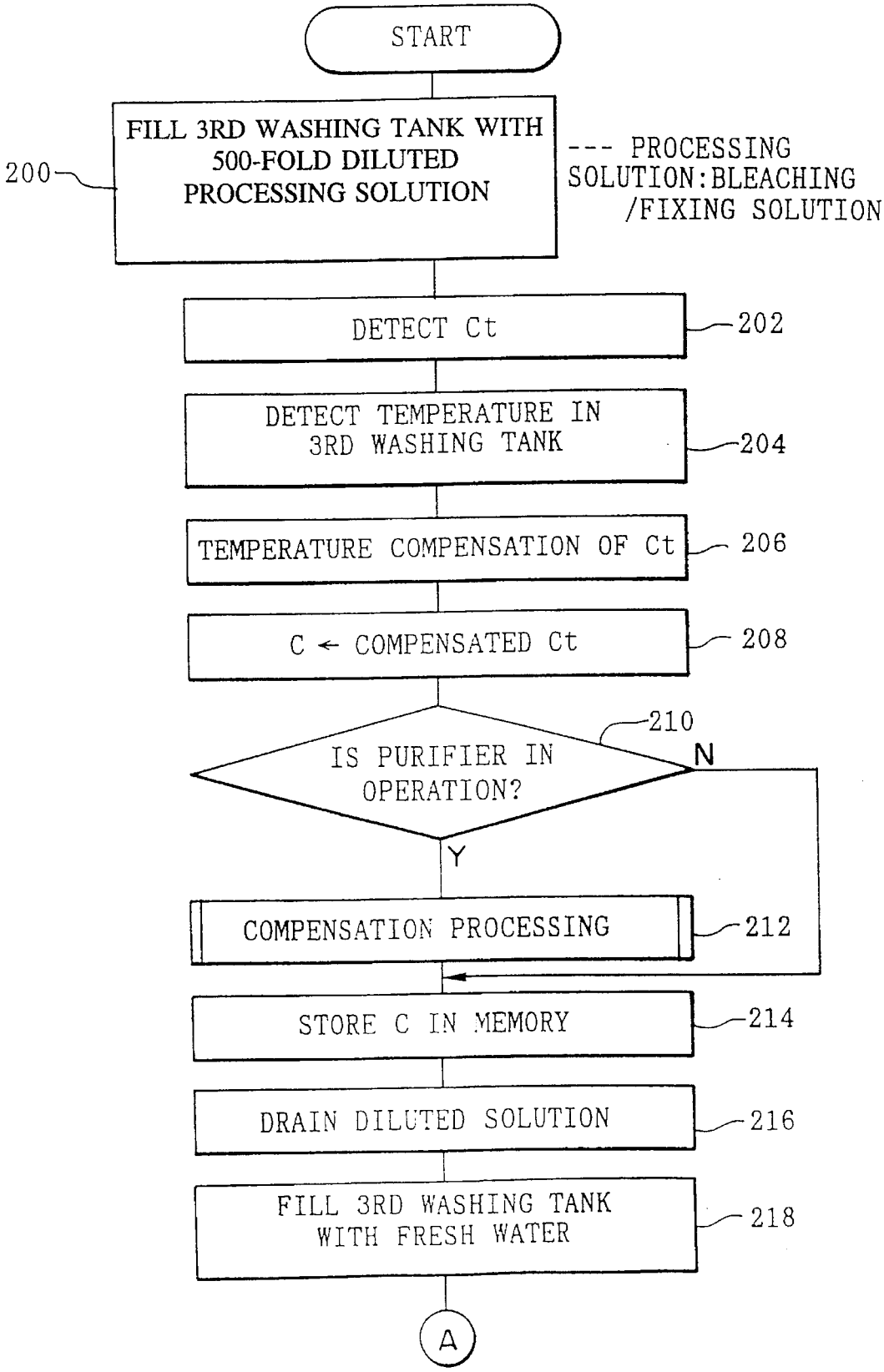
FIGS. 3A and 3B are control flowcharts according to the second embodiment of the present invention.
Figure 3B:
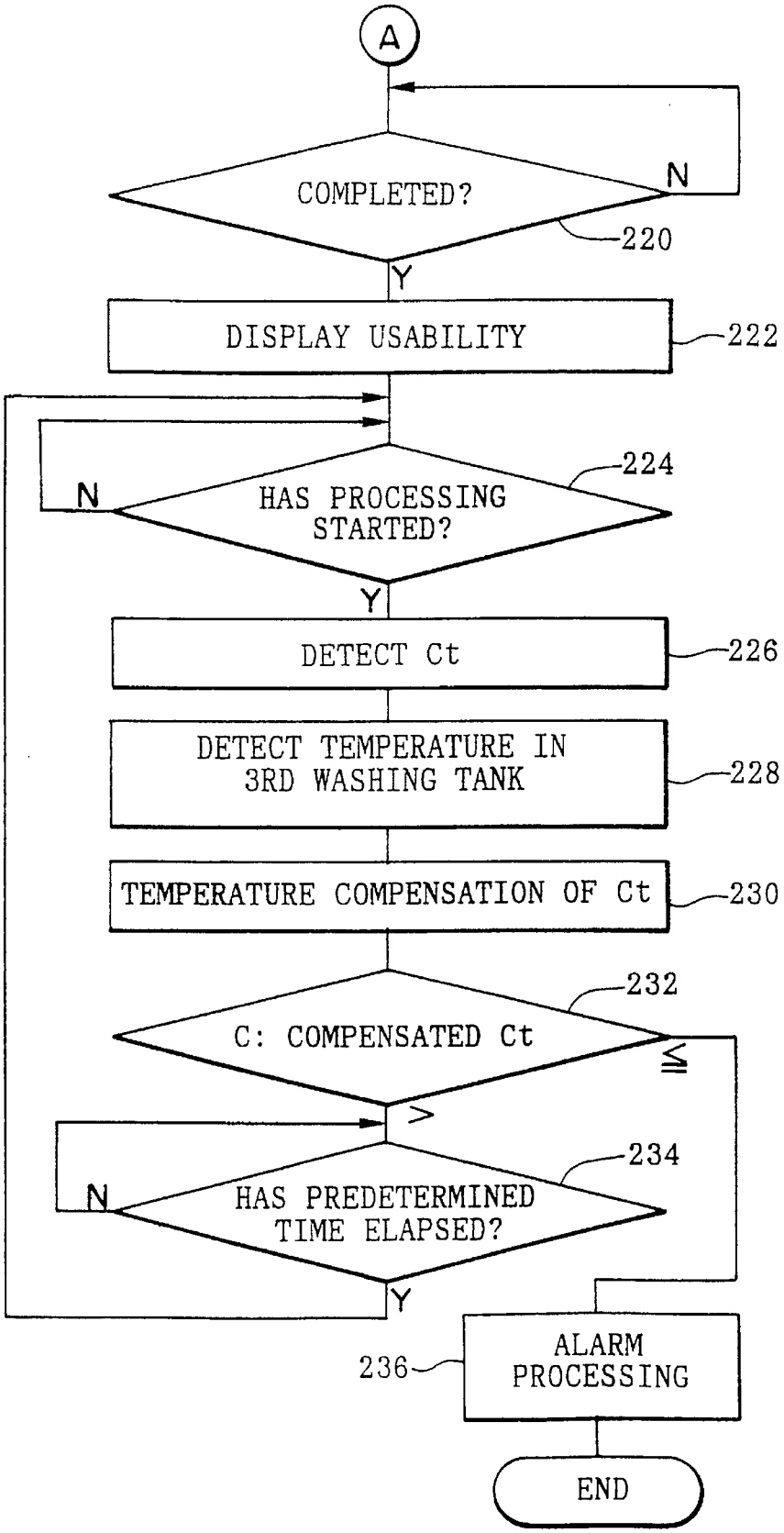

The operation of the second embodiment will be described with reference to the flowcharts shown in FIGS. 3A and 3B.

In step 200, the third washing tank 22C is filled with a 500-fold diluted solution which has been prepared by diluting a stock solution of a bleaching/fixing solution with water. That is, the pump 70 is turned on to supply the diluted solution from the diluted solution tank 72 to the third washing tank 22C.

When the supply of the diluted solution is completed, the processing moves to step 202 to detect the conductivity Ct of the diluted solution in the third washing tank 22C using the sensor 42. In next step 204, the temperature of the washing water in the third washing tank 22C is detected by the sensor 50.

In step 206, temperature compensation is performed for the conductivity Ct, and the compensated conductivity Ct is substituted for the reference conductivity C in step 208.

In next step 210, it is judged whether the purifier 32 is in operation. When an affirmative judgment is made, the processing moves to step 212 in which compensation is performed. The processing then moves to step 214 to store the compensated reference conductivity C in the memory 62. The compensation is performed in the same manner as that which has been described with reference to FIG. 6. When a negative judgment is made in step 210, it is unnecessary to perform compensation. Therefore, the processing moves to step 214 by bypassing step 212.

In next step 216, the CPU 60 operates in step 216 to drain the diluted solution from the third washing tank 22C. After the completion of the draining operation, the CPU 60 operates in step 218 to fill the third washing tank 22C with fresh water. That is, the solenoid valve 74 is turned on by the CPU 60 in step 216 to open its valve passage so as to drain the diluted solution, and is turned off, after the completion of the draining operation, to close the valve passage. In step 218, the pump 38 is operated by the CPU 60 to fill the third washing tank 22C with fresh water.

In step 220, it is judged whether the supply of fresh water is completed. If it is completed, the processing moves to step 222 in which the display unit 64 is operated to display that the processing apparatus is in a usable state.

In next step 224, it is judged whether the processing has been started. When an affirmative judgment is made, the processing moves to step 226 in which the conductivity Ct of washing water in the third washing tank 22C is detected by the sensor 42. In step 228, the temperature of the washing water in the third washing tank 22C is detected by the sensor 50. Subsequently, the processing moves to step 230 to carry out temperature compensation for the conductivity Ct.

In step 232, the CPU 60 compares the reference conductivity C stored in the memory 62 with the detected and compensated conductivity Ct. When it is judged that the measured conductivity Ct is smaller than the reference conductivity C, it means that washing water in the third washing tank 22C has not been contaminated to the degree which affects the processing of the photosensitive material. In this case, the processing moves to step 234 to judge whether a predetermined period of time has elapsed. If an affirmative judgment is made in this step, the processing moves to step 224. When it is judged at step 232 that the measured conductivity Ct is equal to or greater than the reference conductivity C, it means that washing water in the third washing tank 22C has been contaminated to the degree which affects the processing of the photosensitive material. In this case, the processing moves to step 236 to operate the display unit 64 and the alarm 66, thereby informing an operator of the occurrence of an abnormality. The processing is then stopped.

In the above-described second embodiment, the third washing tank 22C is first filled with a diluted solution of a bleaching/fixing solution having a predetermined dilution ratio (for example, 500-fold), and the conductivity of the diluted solution is measured as a reference conductivity C. Accordingly, only the conductivity sensor 42 provided in the third washing tank 22C is required to measure although the sensor 46 attached to the discharge piping of the purifier 32 is also necessary in the event that the purifier 32 is used. Consequently, the structure of the apparatus can be simplified. The processing apparatus in the present embodiment has a structure such that the third washing tank 22C is supplied with a 500-fold diluted solution which has been prepared in advance. However, the structure may be modified to prepare a diluted solution by mixing the stock solution of the bleaching/fixing solution and fresh water whenever the need arises, and to supply the diluted solution to the third washing tank 22C.

Figure 8:
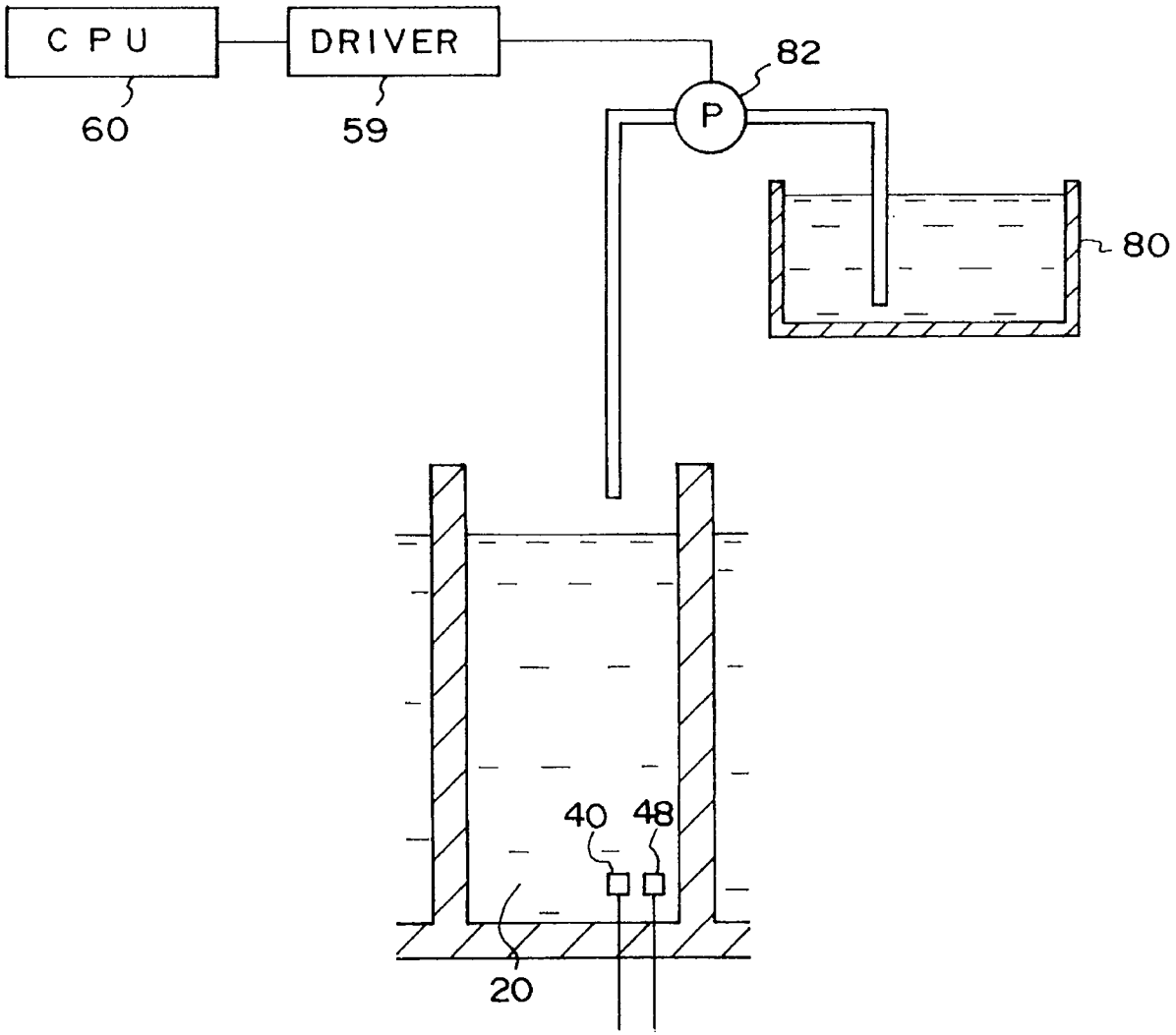
FIG. 8 is a schematic view showing a part of the processing apparatus comprising solution filling and drainage control according to the third embodiment.

Third Embodiment:

Next, a third embodiment of the present invention will be described with reference to FIG. 1 and FIG. 8. The feature of the third embodiment resides in the simplified control in which the reference conductivity is determined based on the conductivity Cp of the mother liquid of a bleaching/fixing solution measured before processing, unlike the first embodiment in which the reference conductivity C is repeatedly stored for renewal. FIG. 8 is a schematic view showing a part of the processing apparatus which part has a unique structure according to the third embodiment. As shown in FIG. 8, there is provided a mother liquid tank 80 to store a mother liquid of a bleaching/fixing solution. The mother liquid tank 80 is connected to the bleaching/fixing tank 20 via a pipe with a pump 82 disposed in the middle thereof. The pump 82 is connected to the CPU 60 via the driver 59, and is turned on and off by the CPU 60. When the pump 82 is operated by the CPU 60, the mother liquid is supplied from the mother liquid tank 80 to the bleaching/fixing tank 20. Other portions of the processing apparatus are the same as those shown in FIG. 1.

Figure 4A:
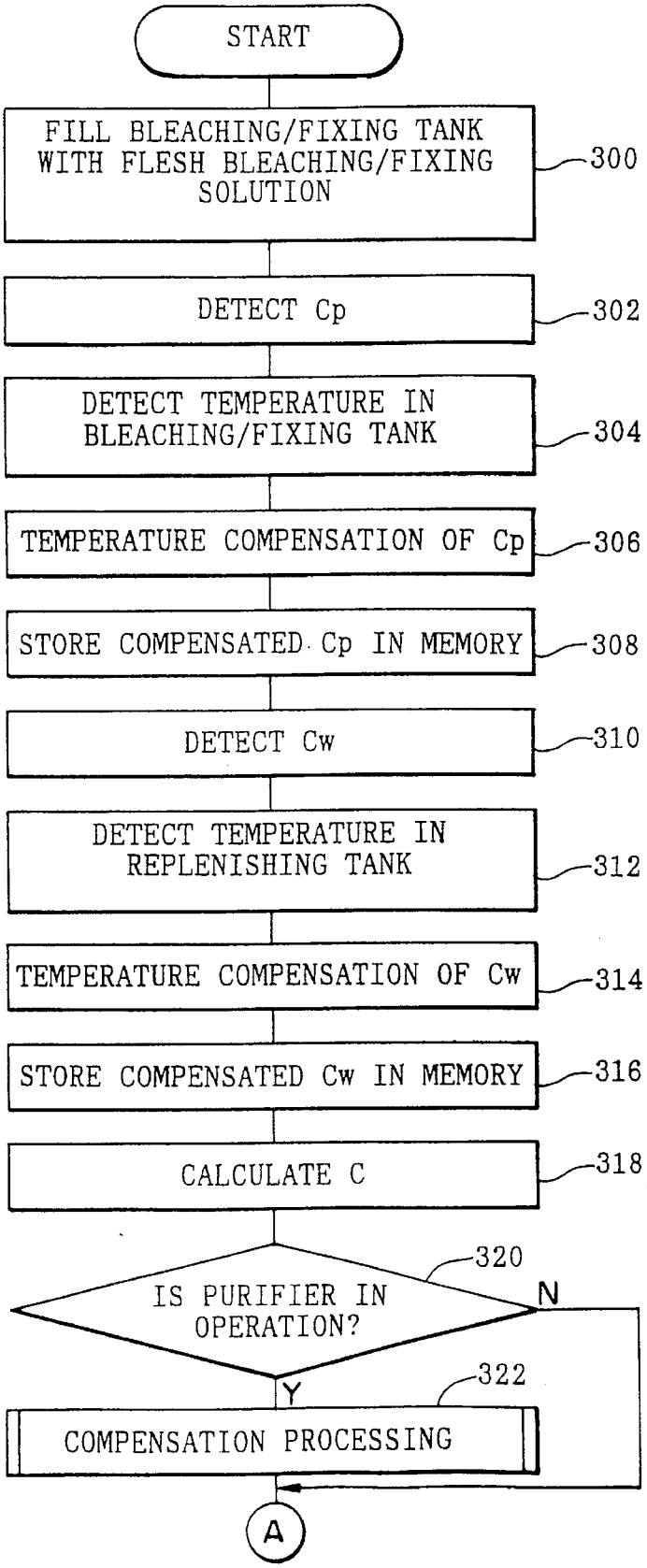
FIGS. 4A and 4B are control flowcharts according to the third embodiment of the present invention.
Figure 4B:
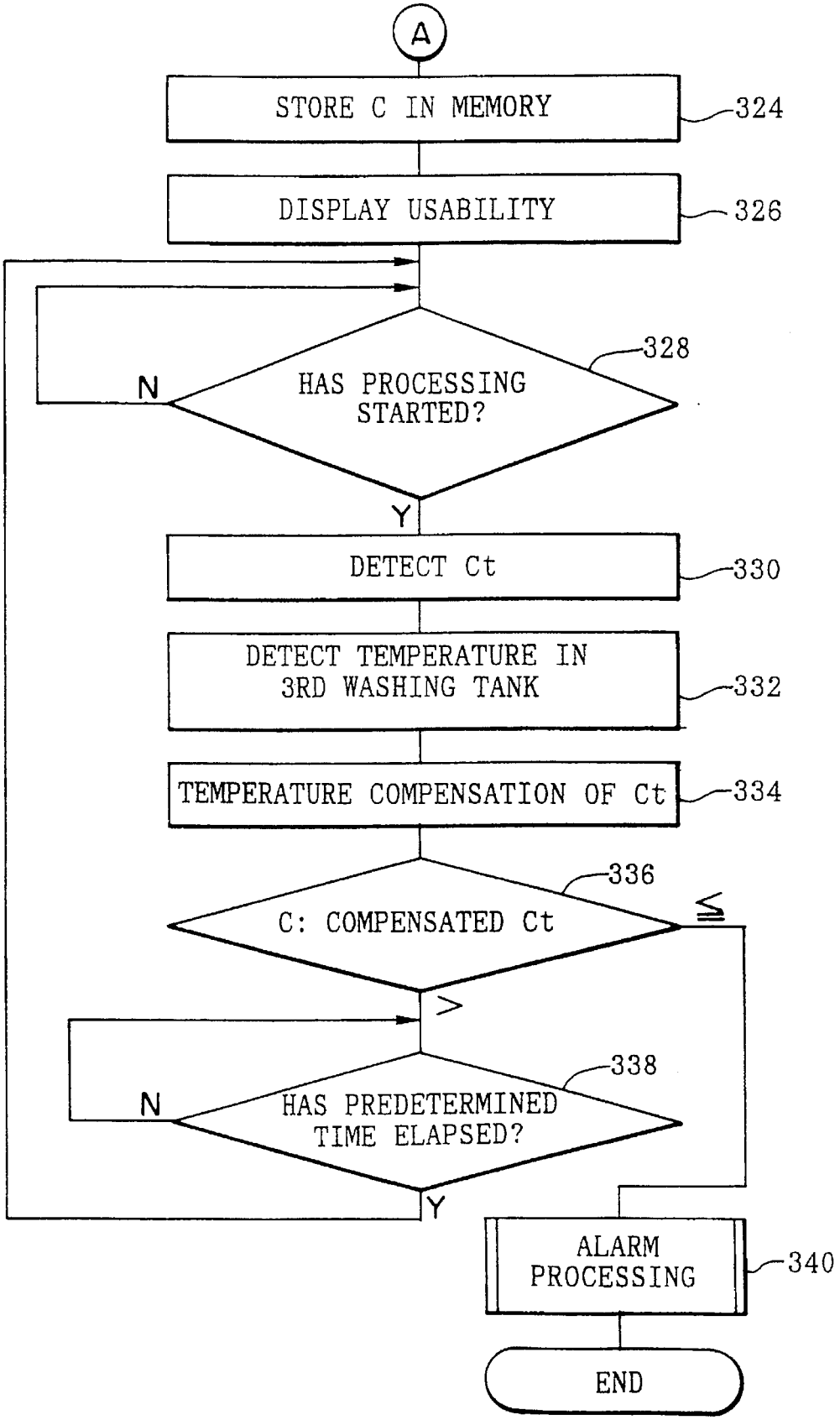

The operation of the third embodiment will be described with reference to the flowcharts shown in FIGS. 4A and 4B.

In step 300, the CPU 60 outputs a command for filling the bleaching/fixing tank 20 with the mother liquid. That is, the pump 82 is turned on by the CPU 60 to supply the mother liquid from the mother liquid tank 80 to the bleaching/fixing tank 20.

When the supply of the mother liquid is completed, the processing moves to step 302 to detect the conductivity Cp of the processing solution in the bleaching/fixing tank 20 using the sensor 40. In next step 304, the temperature of the processing solution is detected by the sensor 48. In step 306, temperature compensation is performed for the detected conductivity Cp of the processing solution, and the compensated conductivity Cp is stored in the memory 62 in step 308.

In next step 310, the conductivity Cw of the replenishing water (fresh water) in the tank 34 is detected by the sensor 44, and in step 312, the temperature of the replenishing water is detected by the sensor 52. In subsequent step 314, the CPU 60 effects temperature compensation for the detected conductivity Cw. The compensated conductivity Cw is stored in the memory 62 in step 316.

In next step 318, the CPU 60 calculates a reference conductivity C in accordance with Equation (4) and based on the compensated conductivity Cp and the compensated conductivity Cw, both stored in the memory 62.

In next step 320, it is judged whether the purifier 32 is in operation. When an affirmative judgment is made, the processing moves to step 322 in which compensation is performed. The processing then moves to step 324 to store the compensated reference conductivity C in the memory 62. The compensation is performed in the same manner as that which has been described with reference to FIG. 6. When a negative judgment is made in step 320, it is unnecessary to perform compensation. Therefore, the processing moves to step 324 by bypassing step 322.

In next step 326, the display unit 64 is operated to display that the processing apparatus is in a usable state.

In next step 328, it is judged whether the processing has been started. When an affirmative judgment is made, the processing moves to step 330 in which the conductivity Ct of washing water in the third washing tank 22C is detected by the sensor 42. In step 332, the temperature of the washing water in the third washing tank 22C is detected by the sensor 50. Subsequently, the processing moves to step 334 to carry out temperature compensation for the conductivity Ct.

In step 336, the CPU 60 compares the reference conductivity C stored in the memory 62 with the detected and compensated conductivity Ct. When it is judged that the measured conductivity Ct is smaller than the reference conductivity C, it means that washing water in the third washing tank 22C has not been contaminated to the degree which affects the processing of the photosensitive material. In this case, the processing moves to step 338 to judge whether a predetermined period of time has elapsed. If an affirmative judgment is made in this step, the processing moves to step 328. When it is judged in step 336 that the measured conductivity Ct is equal to or greater than the reference conductivity C, it means that washing water in the third washing tank 22C has been contaminated to the degree which affects the processing of the photosensitive material. In this case, the processing moves to step 340 to operate the display unit 64 and the alarm 66, thereby informing an operator of the occurrence of an abnormality. The processing is then stopped.

In the above-described third embodiment, the reference conductivity C is determined based on the conductivity Cp of the bleaching/fixing solution (and the conductivity Cw of fresh water in the tank 34) before starting a processing operation, i.e. when the bleaching/fixing tank is filled with the mother liquid. Therefore, the reference conductivity C can be properly set. Since only the conductivity Ct of the washing water is detected during processing, the control can be simplified.

Fourth Embodiment:

Next, a fourth embodiment of the present invention will be described. The portions which are the same as those shown in FIG. 1 are indicated by the same symbols, and description therefor will be omitted.

In the feature of the fourth embodiment resides in predicting the time when the conductivity Ct of the washing water in the third washing tank 22C actually reaches the reference conductivity C. Accordingly, like in the second embodiment, there is used the conductivity sensor 42 provided in the third washing tank 22C (in the case where the purifier 32 is provided, the sensor 46 attached to the discharge piping of the purifier 32 is also necessary). As a result, the structure can be simplified.

Figure 5A:
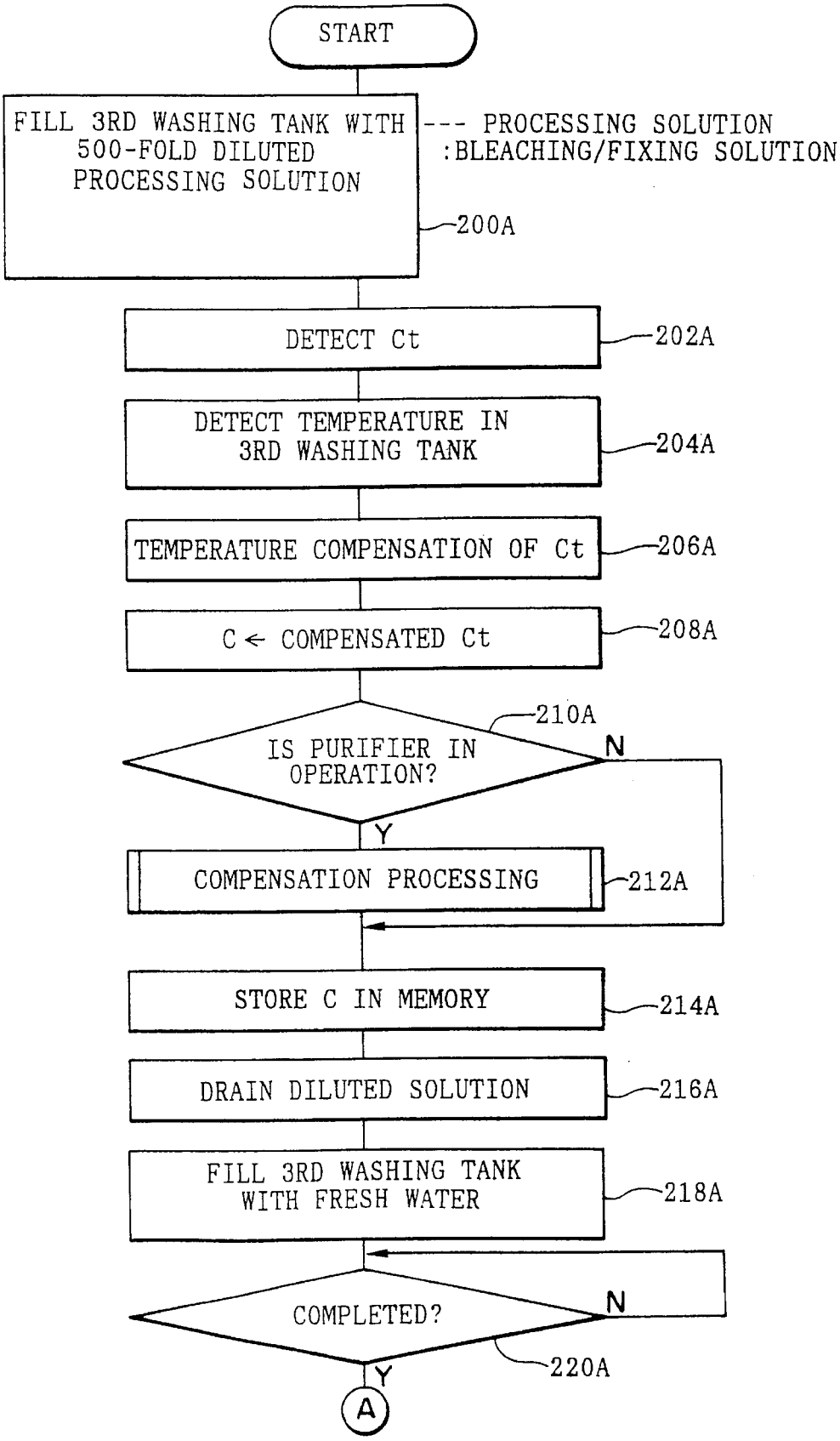
FIGS. 5A and 5B are control flowcharts according to the fourth embodiment of the present invention.
Figure 5B:
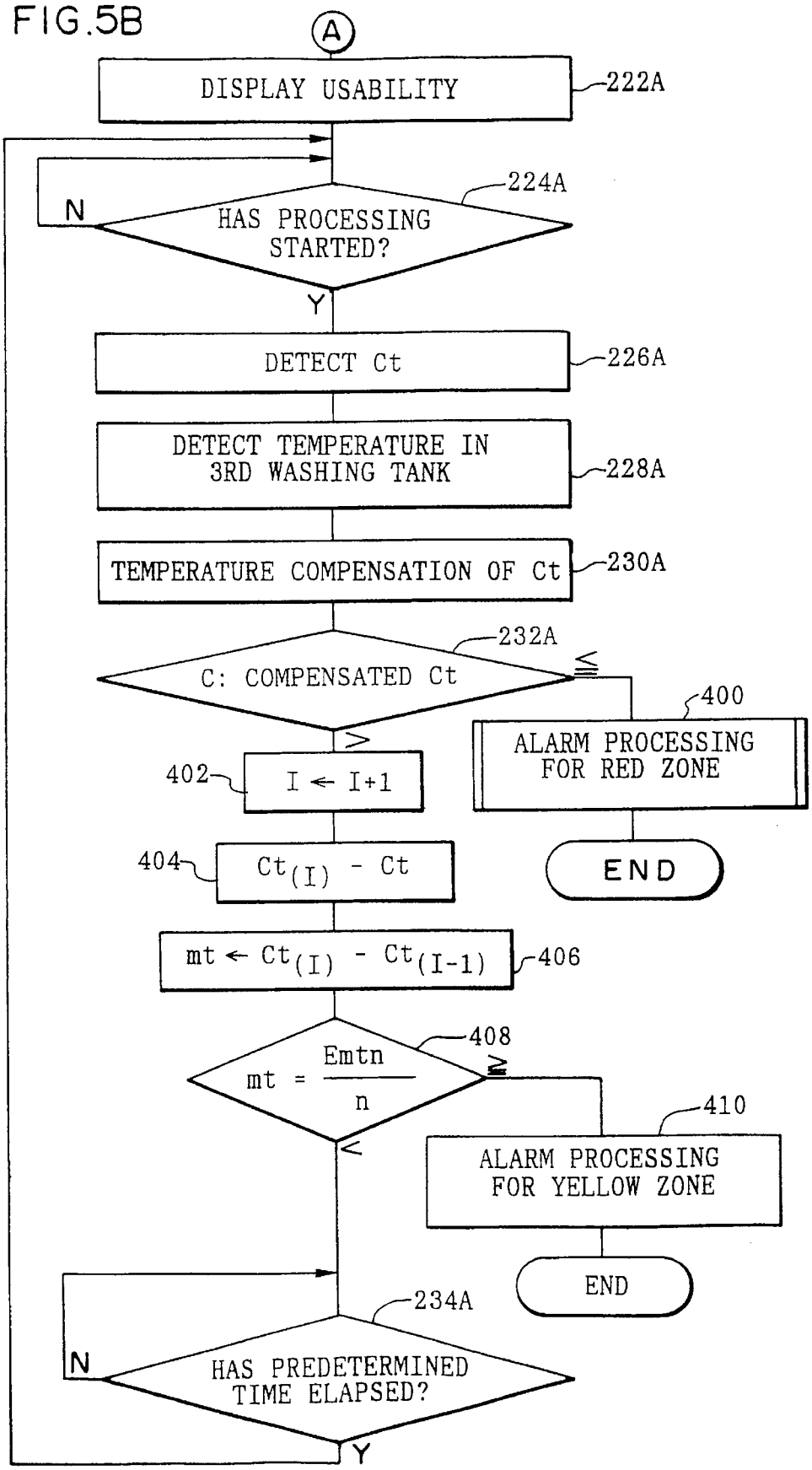

Next, the operation of the fourth embodiment will be described with reference to the flowchart shown in FIGS. 5A and 5B. Processing steps which are the same as those in the flowchart of the second embodiment (see FIGS. 3A and 3B) are indicated by the same symbols with a suffix "A", and description therefor will be omitted.

When it is judged in step 232A that the conductivity Ct of washing water is equal to or greater than the reference conductivity C, the processing moves to step 400 to carry out an alarm processing for a red zone, i.e., to indicate an abnormality in which the conductivity Ct of the washing water in the third washing tank 22C increases to a degree that affects the processing.

When it is judged in step 232A that the conductivity Ct is smaller than the reference conductivity C, the processing moves to step 402 to increment the variable I. Subsequently, the current conductivity Ct of the washing water in the third washing tank 22C is substituted for $Ct_{(I)}$ in step 404.

In step 406, the conductivity $Ct_{(I-1)}$ of the washing water detected in the previous cycle is read out to calculate a variation mt by subtracting the conductivity $Ct_{(I-1)}$ from the current conductivity $Ct_{(I)}$ ($mt=Ct_{(I)}-Ct_{(I-1)}$.

In step 408, the variation mt is compared with the average value of variations obtained in n past operational cycles (for example, 10 past operational cycles). When the variation mt calculated this time is smaller than the average value, it is judged that no large variation occurs in the degree of contamination, and the processing moves to step 234A. When the variation mt calculated this time exceeds the average value, the processing moves to step 410 to carry out an alarm processing for a yellow zone, i.e., a processing for calling an operator's attention. Thereafter, the processing is ended.

According to the fourth embodiment, it is possible to quickly detect, for example, the abnormal state in which a large amount of washing water leaks due to a breakage (or a malfunction) of the check valve 30 or the like provided between the washing tanks.

In the above-described embodiments, the present invention is applied to the photosensitive material processing apparatus with the mulch-chamber washing section 22. However, the present invention can be applied to photosensitive material processing apparatus having an ordinary washing section in which a plurality of washing tanks are lined in series.

As described above, the method of monitoring washing water used in developing process for a photosensitive material according to the present invention can accurately detect the degree of the mixture of a processing solution of a preceding stage into the washing water in the final washing tank, thereby making it possible to replenish or exchange the washing water with a proper amount of fresh water at a proper timing. The present invention therefore improves the maintainability of the washing tank without deteriorating the quality of development of a photosensitive material.

What is claimed is:

1. A method of monitoring washing solution used in a developing process of a color silver halide photosensitive material, wherein washing solution stored in a washing tank, which is one of a plurality of processing tanks for processing the photosensitive material, is monitored so as to determine the degree of mixing of the washing solution with at least one processing solution, wherein said processing solution comprises at least one of a bleaching solution and a fixing solution, wherein mixing of the processing solution and washing solution occurs due to processing of the photosensitive material in at least one processing tank prior to processing in said washing tank, said method comprising the steps of:

(a) calculating, at at least one interval, a reference value for the washing solution in the washing tank in accordance with an equation based on the conductivity of the processing solution stored in the processing tank and the conductivity of replenishing solution for replenishing the washing tank, and storing the reference value in a memory means to update the reference value;

(b) measuring the conductivity of the washing solution in the washing tank at periodic intervals; and (c) comparing the measured conductivity of the washing solution and the reference value to determine the degree of mixing of the processing solution in the washing solution in the washing tank.

2. A method of monitoring washing solution used in a developing process of a color silver halide photosensitive material according to claim 1, further comprising the step of predicting, based on variation in the measured conductivity of the washing solution, the time when the conductivity of the washing solution reaches the reference value.

3. A method of monitoring washing solution used in a developing process of a color silver halide photosensitive material according to claim 1, wherein the equation is the following equation:

$$C = Cp \cdot \frac{1}{m} + Cw \cdot \frac{m-1}{m},$$

wherein C is the reference value, Cp is the conductivity of the processing solution, Cw is the conductivity of the replenishing solution, and m is the dilution ratio.

4. A method of monitoring washing solution used in a developing process of a color silver halide photosensitive material according to claim 1, wherein the equation is the following equation:

$$C=Cp/m+Cw+f(m)$$

wherein C is the reference value, Cp is the conductivity of the processing solution, Cw is the conductivity of the replenishing solution, m is the dilution ratio, and f(m) is a term for chemical compensation corresponding to variation due to the addition of an additive into the washing solution.

5. A method of monitoring washing solution used in a developing process of a color silver halide photosensitive material according to claim 1, wherein the step (a) further comprises the step of effecting temperature compensation for the conductivity of the processing solution and the conductivity of the replenishing solution before these values are used in the calculation in accordance with the equation, and the step (c) further comprises the step of effecting temperature compensation for the measured conductivity of the washing solution before the measured conductivity is compared with the reference value.

6. A method of monitoring washing solution used in a developing process of a color silver halide photosensitive material according to claim 1, wherein the step (a) comprises the step of compensating the reference value based on the conductivity of purified washing solution when the washing solution in the washing tank is subjected to purification treatment.

7. A method of monitoring washing solution used in a developing process of a color silver halide photosensitive material according to claim 1, further comprising the step (d) of effecting an alarm process when the result of the comparison in the step (c) indicates that the measured conductivity of the washing solution exceeds the reference value.

8. A method of monitoring washing solution used in a developing process of a color silver halide photosensitive material according to claim 7, wherein in said step (c), the amount of variation in conductivity per unit time and at least one of the amount of variation in conductivity per unit area of the processed photosensitive material is calculated from conductivities obtained from measurements of a plurality of prior intervals, and is respectively compared to the reference value.

9. A method of monitoring washing solution used in a developing process of a color silver halide photosensitive material according to claim 1, wherein the washing tank is the final washing tank when a plurality of washing tanks are provided along the direction of processing of the photosensitive material.

10. A method of monitoring washing solution used in a developing process of a color silver halide photosensitive material, wherein washing solution stored in a washing tank, which is one of a plurality of processing tanks for processing the photosensitive material, is monitored so as to determine the degree of mixing of the washing solution with at least one processing solution wherein said processing solution comprises at least one of a: bleaching solution and fixing solution wherein mixing of the processing solution and washing solution occurs due to processing of the photosensitive material in at least one processing tank prior to processing in said washing tank, said method comprising the steps of:

(a) measuring the conductivity of a fresh processing solution and the conductivity of the washing solution in the washing tank, after filling the processing tank with the fresh processing solution;

(b) calculating a reference value for the washing solution in the washing tank based on the results of the measurement and in accordance with an equation based on the conductivity of the processing solution and the conductivity of replenishing solution for replenishing the washing tank, and storing the reference value in a memory means;

(c) measuring the conductivity of the washing solution in the washing tank at periodic intervals; and (d) comparing the measured value of the washing solution and the reference value to determine the degree of mixing of the processing solution in the washing solution in the washing tank.

11. A method of monitoring washing solution used in a developing process of a color silver halide photosensitive material according to claim 10, further comprising the step (e) of predicting, based on variation in the measured conductivity of the washing solution, the time when the conductivity of the washing solution reaches the reference value.

12. A method of monitoring washing solution used in a developing process of a color silver halide photosensitive material according to claim 11, wherein in said step (d), at least one of an amount of variation in conductivity per unit time and an amount of variation in conductivity per unit area of the processed photosensitive material is calculated from conductivities obtained from measurements of a plurality of prior intervals and is respectively compared to the reference value.

13. A method of monitoring washing solution used in a developing process of a color silver halide photosensitive material according to claim 10, wherein the equation is the following equation:

$$C = Cp \cdot \frac{1}{m} + Cw \cdot \frac{m-1}{m},$$

wherein C is the reference value, Cp is the conductivity of the processing solution, Cw is the conductivity of the replenishing solution, and m is a dilution ratio.

14. A method of monitoring washing solution used in a developing process of a color silver halide photosensitive material according to claim 10, wherein the equation is the following equation:

$$C=Cp/m+Cw+f(m)$$

wherein C is the reference value, Cp is the conductivity of the processing solution, Cw is the conductivity of the replenishing solution, m is a dilution ratio, and f(m) is a term for chemical compensation corresponding to variation due to the addition of an additive into the washing solution.

15. A method of monitoring washing solution used in a developing process of a color silver halide photosensitive material according to claim 10, further comprising the step of effecting temperature compensation for the conductivity of the fresh processing solution and the conductivity of the washing solution in the washing tank, which are measured in the step (a), before these values are used in the calculation in accordance with the equation in the step (b), and the step of effecting temperature compensation for the measured conductivity of the washing solution, which is measured in the step (c), before the measured conductivity is compared with the reference value in the step (d).

16. A method of monitoring washing solution used in a developing process of a silver halide photosensitive material according to claim 10, wherein the step (b) further comprises the step of compensating the reference value based on the conductivity of purified washing solution, before the reference value is stored, when the washing solution in the washing tank is subjected to purification treatment.

17. A method of monitoring washing solution used in a developing process of a color silver halide photosensitive material according to claim 16, further comprising the step (e) of effecting an alarm process when the result of the comparison in the step (d) indicates that the measured conductivity of the washing solution exceeds the reference value.

18. A method of monitoring washing solution used in a developing process of a color silver halide photosensitive material according to claim 10, wherein the washing tank is the final washing tank when a plurality of washing tanks are provided along the direction of processing of the photosensitive material.

19. A method of monitoring washing solution used in a developing process of a silver halide photosensitive material, wherein washing solution stored in a washing tank, which is one of a plurality of processing tanks for processing the photosensitive material, is monitored so as to determine the degree of mixing of the washing solution with at least one processing solution, wherein mixing of the processing solution and washing solution occurs due to processing of the photosensitive material in at least one processing tank prior to processing in said washing tank, said method comprising the steps of:

(a) calculating, at at least one interval, a reference value for the washing solution in the washing tank in accordance with an equation based on the conductivity of the processing solution stored in the processing tank and the conductivity of replenishing solution for replenishing the washing tank, and storing the reference value in a memory means to update the reference value;

(b) measuring the conductivity of the washing solution in the washing tank at periodic intervals; and (c) comparing the measured conductivity of the washing solution and the reference value to determine the degree of mixing of the processing solution in the washing solution in the washing tank.

20. A method of monitoring washing solution used in a developing process of a silver halide photosensitive material according to claim 19, further comprising the step of predicting, based on variation in the measured conductivity of the washing solution, the time when the conductivity of the washing solution reaches the reference value.

21. A method of monitoring washing solution used in a developing process of a silver halide photosensitive material according to claim 19, wherein the equation is the following equation:

$$C=Cp/m+Cw+f(m),$$

wherein C is the reference value, Cp is the conductivity of the processing solution, Cw is the conductivity of the replenishing solution, m is a dilution ratio, and f(m) is a term for chemical compensation corresponding to variation due to the addition of an additive into the washing solution.

22. A method of monitoring washing solution used in a developing process of a silver halide photosensitive material according to claim 19, wherein the step (a) further comprises the step of effecting temperature compensation for the conductivity of the processing solution and the conductivity of the replenishing solution before these values are used in the calculation in accordance with the equation, and the step (c) further comprises the step of effecting temperature compensation for the measured conductivity of the washing solution before the measured conductivity is compared with the reference value.

23. A method of monitoring washing solution used in a developing process of a silver halide photosensitive material, wherein washing solution stored in a washing tank, which is one of a plurality of processing tanks for processing the photosensitive material, is monitored so as to determine the degree of mixing of the washing solution with at least one processing solution, wherein mixing of the processing solution and washing solution occurs due to processing of the photosensitive material in at least one processing tank prior to processing in said washing tank, said method comprising the steps of:

(a) measuring the conductivity of fresh processing solution and the conductivity of the washing solution in the washing tank, after filling the processing tank with the fresh processing solution;

(b) calculating a reference value for the washing solution in the washing tank based on the results of the measurement and in accordance with an equation based on the conductivity of the processing solution and the conductivity of replenishing solution for replenishing the washing tank, and storing the reference value in a memory means;

(c) measuring the conductivity of the washing solution in the washing tank at periodic intervals; and (d) comparing the measured conductivity of the washing solution and the reference value to determine the degree of mixing of the processing solution in the washing solution in the washing tank.

24. A method of monitoring washing solution used in a developing process of a silver halide photosensitive material according to claim 23, further comprising the step (e) of predicting, based on variation in the measured conductivity of the washing solution, the time when the conductivity of the washing solution reaches the reference value.

25. A method of monitoring washing solution used in a developing process of a silver halide photosensitive material according to claim 23, wherein the equation is the following equation:

$$C=Cp/m+Cw+f(m),$$

wherein C is the reference value, Cp is the conductivity of the processing solution, Cw is the conductivity of the replenishing solution, m is a dilution ratio, and f(m) is a term for chemical compensation corresponding to variation due to the addition of an additive into the washing solution.

26. A method of monitoring washing solution used in a developing process of a silver halide photosensitive material according to claim 23, further comprising the step of effecting temperature compensation for the conductivity of the fresh processing solution and the conductivity of the washing solution in the washing tank, which are measured in the step (a), before these values are used in the calculation in accordance with the equation in the step (b), and the step of effecting temperature compensation for the measured conductivity of the washing solution, which is measured in the step (c), before the measured conductivity is compared with the reference value in the step (d).

27. A method of monitoring washing solution, using a computer, wherein said solution is used in a developing process of a silver halide photosensitive material, wherein washing solution stored in a washing tank, which is one of a plurality of processing tanks for processing the photosensitive material, is monitored so as to determine the degree of mixing of the washing solution with at least one processing solution, wherein mixing of the processing solution and washing solution occurs due to processing of the photosensitive material in at least one processing tank prior to processing in said washing tank, said method comprising the steps of:

(a) calculating, at at least one interval, a reference value from signals corresponding to the conductivity of the processing solution and the conductivity of a replenishing solution for said washing solution, in accordance with an equation;

(b) measuring the conductivity of the washing solution at periodic intervals; and (c) comparing the measured conductivity and the reference value to determine the degree of mixing of the processing solution in the washing solution.

28. The method of monitoring washing solution according to claim 27, wherein said equation is the following:

$$C = Cp \cdot \frac{1}{m} + Cw \cdot \frac{m-1}{m},$$

wherein C is the reference value, Cp is the conductivity of the processing solution, Cw is the conductivity of the replenishing solution, and m is the dilution ratio.

29. A method of monitoring washing solution, using a computer, wherein said washing solution is used in a developing process of a silver halide photosensitive material, wherein washing solution stored in a washing tank, which is one of a plurality of processing tanks for processing the photosensitive material, is monitored so as to determine the degree of mixing of the washing solution with at least one processing solution, wherein mixing of the processing solution and washing solution occurs due to processing of the photosensitive material in at least one processing tank prior to processing in said washing tank, said method comprising the steps of:

(a) measuring the conductivity of fresh processing solution and the conductivity of the washing solution after filling the processing tank with the fresh processing solution;

(b) calculating a reference value from signals corresponding to the measured conductivity of the processing solution and the measured conductivity of a replenishing solution for said washing solution, in accordance with an equation;

(c) measuring the conductivity of the washing solution at periodic intervals; and (d) comparing the measured conductivity and the reference value to determine the degree of mixing of the processing solution in the washing solution in the washing tank.

30. The method of monitoring washing solution according to claim 29, wherein said equation is the following:

$$C = Cp \cdot \frac{1}{m} + Cw \cdot \frac{m-1}{m},$$

wherein C is the reference value, Cp is the conductivity of the processing solution, Cw is the conductivity of the replenishing solution, and m is the dilution ratio.

* * * * *